US005371965A

United States Patent [19]

Nelson

[11] Patent Number: 5,371,965

[45] Date of Patent: Dec. 13, 1994

[54] GUN SAFETY DEVICE AND INDICATOR

[76] Inventor: Stephen G. Nelson, 469 Canyon Dr., Solana Beach, Calif. 92075

[21] Appl. No.: 13,962

[22] Filed: Feb. 5, 1993

[51] Int. Cl.[5] ..... F41A 17/54

[52] U.S. Cl. ..... 42/70.07; 42/1.01

[58] Field of Search ..... 42/70.07, 70.06, 70.11, 42/1.01

[56] References Cited

U.S. PATENT DOCUMENTS

| | | | |
|---|---|---|---|
| 2,080,202 | 5/1937 | Drake | 42/1 |
| 2,590,516 | 3/1952 | De Von Breymann | 42/70 |
| 3,022,596 | 5/1960 | Cannon | 42/1 |
| 3,713,239 | 1/1973 | Sperling | 42/1 |
| 3,732,641 | 5/1973 | Adajian | 42/1 |
| 4,443,962 | 4/1984 | Bernet et al. | 42/16 |
| 4,723,370 | 2/1988 | Sheehan | 42/70.07 |
| 4,825,576 | 2/1989 | Troncoso et al. | 42/70.07 |
| 4,912,867 | 4/1990 | Dukes, Jr. | 42/70.11 |
| 4,945,665 | 8/1990 | Nelson | 42/70.07 |
| 5,033,218 | 7/1991 | Nelson | 42/70.07 |
| 5,075,994 | 12/1991 | Nishioka | 42/70.07 |

FOREIGN PATENT DOCUMENTS

| | | | |
|---|---|---|---|
| 4626 | of 1905 | United Kingdom | 42/70.07 |

*Primary Examiner*—Stephen M. Johnson

*Attorney, Agent, or Firm*—Brown, Martin, Haller & McClain

[57] ABSTRACT

The gun safety indicator is a generally oval, round or ovoid-shaped cup with a lip or flange around its perimeter. The bottom of the cup is a diaphragm which will flex when pressure is applied. In its relaxed state, the diaphragm has a circumference equal to or slightly larger than the circumference of the opening between the trigger guard and the trigger with the trigger depressed. The safety indicator is pushed through the trigger guard opening of an unloaded gun with the user's thumb on the inner side of the pressure diaphragm. The applied force deforms the diaphragm enough to decrease its effective circumference, allowing it to pass through the trigger guard opening. Due to the close fit, the pressure of the inner edge of the trigger guard compresses the sidewall of the cup such that the sidewall closest to the diaphragm bulges outward around the edges of the trigger guard to hold the device in place.

5 Claims, 1 Drawing Sheet

GUN SAFETY DEVICE AND INDICATOR

As the number of people who keep guns for protection increases, accidents involving guns also increase. Most often, these accidents occur because the gun is handled in a casual manner by someone who is unaware that the gun is loaded.

A number of gun safety devices have been made available for use on both loaded and unloaded guns. These devices range from caps covering the trigger guard to keyed locks that encase the trigger. Many of these devices are not simple to manufacture and, thus, tend to be somewhat expensive, which acts as an obstacle to widespread acceptance of the devices. While these devices are effective in preventing the trigger from being depressed when they are used properly, some may be easily removed and others are so inconvenient as to discourage proper installation or regular use. Further, since many of these devices can be used on loaded guns, someone who is handling the gun has no indication of whether or not the gun is loaded and capable of firing when the trigger lock is removed.

In U.S. Pat. Nos. 4,945,665, issued Aug. 7, 1990, and 5,033,218, issued Jul. 23, 1991, the present inventor disclosed quick-release gun trigger safety devices that fit firmly within the trigger guard of the gun with the trigger depressed. The devices are made of resilient material that allows insertion or removal by collapsing one of a pair of flexible flanges extending from the device's central portion. These devices may be used on loaded or unloaded weapons, and give the appearance that the gun is not disabled. The sturdy construction of these devices is intended to provide a deterrent against removal of the device by requiring normal adult hand strength for removal. This type of protection is clearly desirable, and in many states required by law, when the weapon is loaded, but may not be necessary on an unloaded weapon. Nonetheless, it is unwise to leave an unloaded gun completely unprotected since it is possible that the last user of the gun failed to realize that an unfired round was still left in the chamber. Also, the next person to handle the gun may be at considerable risk if no indication is provided as to whether or not the gun is safe.

In a recent comprehensive study by the United States Government Accounting Office (GAO), it was found that the diversity in gun designs is so great that it would be virtually impossible to design a universal loading indicator that could be used on all guns or firearms. For this reason the study concluded that it would be unlikely that any universal means would become available as would be necessary to support federal or state regulations requiring use of such devices.

SUMMARY OF THE INVENTION

It is an advantage of the present invention to provide a gun safety indicator for use in unloaded guns that will fit a large number of different gun configurations.

It is another advantage of the present invention to provide a gun safety indicator that is of simple construction and is inexpensive to manufacture, making it more practical for widespread use.

In an exemplary embodiment, the gun safety indicator is a generally oval, round or ovoid-shaped cup with a lip or flange around its perimeter. The bottom of the cup is a diaphragm which will flex when pressure is applied. In its relaxed state, the diaphragm has a circumference equal to or slightly larger than the circumference of the opening between the trigger guard and the trigger with the trigger depressed. The safety indicator is pushed through the trigger guard opening of an unloaded gun with the user's thumb on the inner side of the pressure diaphragm. The applied force deforms the diaphragm enough to decrease its effective circumference, allowing it to pass through the trigger guard opening. Due to the close fit, the pressure of the inner edge of the trigger guard compresses the sidewall of the cup such that the sidewall closest to the diaphragm bulges outward around the edges of the trigger guard to hold the device in place. The cross-sectional structure of the device is such that the diaphragm is relatively thick compared with the sidewalls, which are thin and flexible. This allows the diaphragm to be deformed as it is pushed through the trigger guard then resile after passing through it while the sidewalls remain flexible conform to the inner edge of the trigger guard.

The material of which the gun safety indicator is made is a flexible plastic or polymer, such as polypropylene or polyurethane. A simple two-piece mold can be used in a single step molding process. The shape of the safety indicator need not be the exact shape of the opening in the trigger guard since it is flexible and conformable. Selection of the appropriate size indicator is determined by the circumference of the trigger guard/-trigger opening and the desired level of resistance to removal. While color is a matter of choice, the preferred embodiment is blue, the universal color for "cold", which, in this case, means "safe".

BRIEF DESCRIPTION OF THE DRAWINGS

Understanding of the present invention will be facilitated by consideration of the following detailed description of a preferred embodiment of the present invention, taken in conjunction with the accompanying drawings, in which like reference numerals refer to like parts and in which.

DETAILED DESCRIPTION OF THE PREFERRED EMBODIMENT

Figure 1:
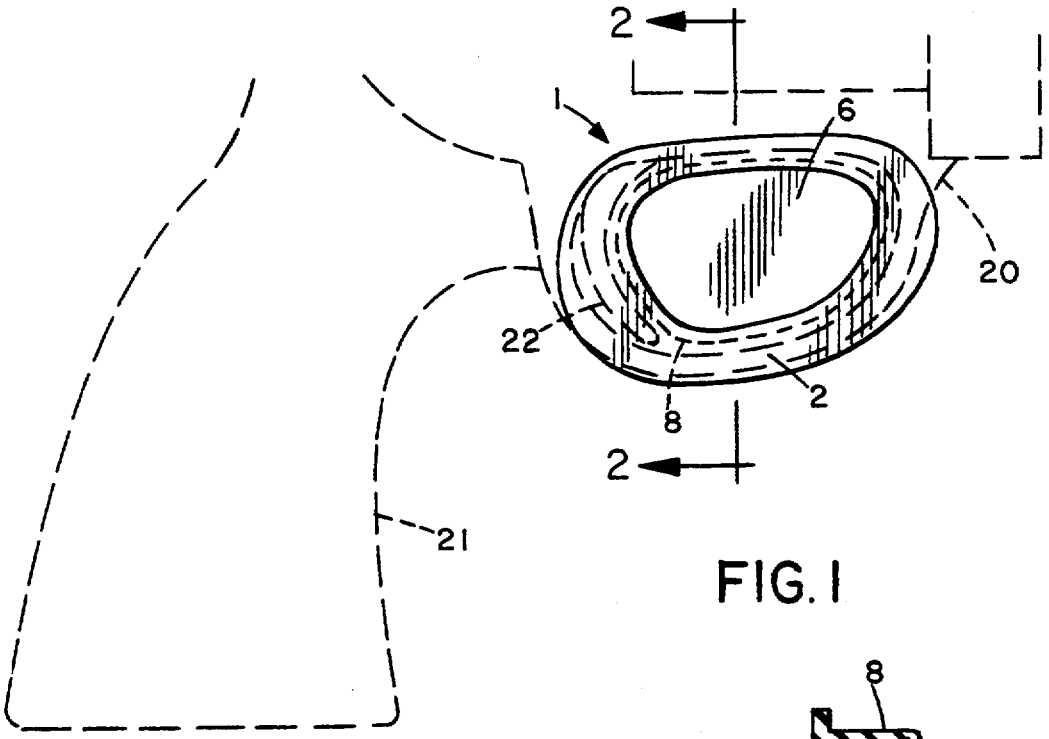
FIG. 1 is a side view of the gun safety indicator of the present invention.
Figure 2:
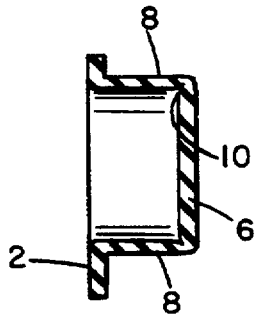
FIG. 2 is a cross-sectional view taken along line 2—2 of FIG. 1.

As illustrated in FIG. 1, the gun safety indicator 1 is a generally oval or rounded cup with a perimeter circumference generally matching the circumference of the opening in a gun trigger guard 20 when the trigger 22 is depressed. (Gun 21 is illustrated in phantom to indicate the placement of the indicator 1.) A lip or flange 2 runs around the perimeter of the cup. The interior configuration of the cup can be better seen in FIG. 2. The diaphragm 6, the "bottom" of the cup, may be flattened or slightly curved and has a circumference the same size or slightly larger than the opening in the trigger guard 20 when the trigger 22 is depressed. The thickness of the diaphragm 6 is greater than that of sidewall 8. The wall thickness of diaphragm 6, while still flexible, provides a degree of rigidity to the safety indicator, compared to thickness of sidewall 8, to allow it to stay firmly in place when inserted in the trigger guard and also to provide a durable surface on which force can be exerted to insert or remove the safety indicator 1.

Sidewall 8 is thin enough to allow it to flex and conform when inserted within the trigger guard 20, which exerts an inward force on the sidewall 8. A groove or indentation 10 may be formed at the intersection of the diaphragm 6 and the sidewall 8 to provide further flexibility in allowing the diaphragm 6 to deform and the sidewall 8 to compress inward. Indentation 10 is preferably formed around the entire intersection, but it may also be formed as separate grooves at several locations, or need not be present at all, as long as there is sufficient flexibility to allow insertion or removal without requiring excessive strength.

An important object of the invention is to provide a device that is child-proof in situations where a child may be living in or visiting the household or other location where the gun is kept. The strength required to remove the safety indicator can be selected by using a safety indicator of a circumference larger than the circumference of the trigger guard/trigger opening to provide maximum safety, or of a smaller circumference, closer to that of the opening, if no children might gain access to the gun. In the latter case, the safety indicator need only De tight enough to stay in place when inserted as opposed to providing a degree of resistance to removal.

Figure 3:
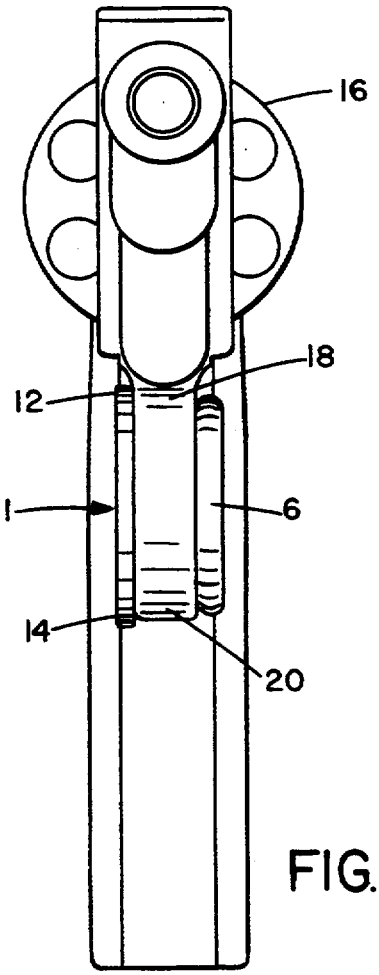
FIG. 3 is a front view of a gun with a trigger guard with the gun safety indicator inserted.

Flange 2 is not uniform around the perimeter of the cup. It is narrower at its top to avoid interference by the body of the gun 16 at the upper portion 18 of the trigger guard. The variation in flange width is illustrated in FIG. 3, with top 12 being shown as narrower than bottom 14. Flange 2 can be a lip or other radial extension from the sidewall, and need not be the angular configuration normally associated with "flange". The purpose of this element is to prevent the indicator 1 from passing completely through the trigger guard/-trigger opening, and virtually any increase in circumference will achieve this purpose.

Figure 4:
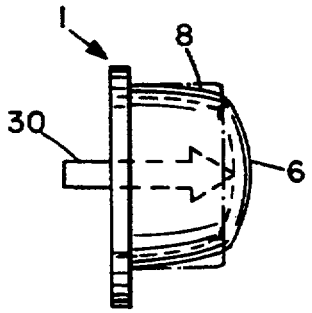
FIG. 4 is a front view of the gun safety indicator with pressure applied to deform the diaphragm.

To insert the safety indicator 1, the user first must verify that the gun is unloaded. The safety indicator 1 is positioned to match the outer side of diaphragm 6 with the opening in the trigger guard with the trigger depressed. The deformation of the diaphragm 6 is illustrated in FIG. 4, with the dashed line showing the relative circumference of the relaxed state. By placing a thumb on the inside of diaphragm 6 and applying force, indicated as arrow 30, the user pushes it against the trigger guard so that the diaphragm deforms slightly, decreasing its effective circumference and allowing it to enter the opening between the trigger guard and the trigger. The sidewall begins to compress and the application of force is continued until further progress is halted by flange 2. Due to its greater rigidity as compared with the sidewall 8, diaphragm 6 resiles to its undeformed dimension once it has passed through to the side of the trigger guard opposite the flange 2, causing the sidewall 8 closest to the diaphragm to bulge out slightly, as shown in FIG. 3, so that the safety indicator is firmly held within the trigger guard.

For removal, the user pushes on the outer side of diaphragm 6 to deform it, decreasing its effective circumference enough to pass it back through the opening in the trigger guard.

Although trigger guards in various guns differ stylistically, with some having slightly more elongated openings than others, the conformability of the safety indicator allows it to be used in any trigger guard that has a compatible circumference. The range in circumferences of trigger guard openings is not extensive since, in every case, the opening is designed to allow the user's finger to be inserted, but not so large as to expose the trigger to inadvertent contact. Commercially, a number of safety indicators can be made available with incrementally increasing circumferences to cover this relatively narrow range. The user would then select the circumference best suited to the trigger guard dimensions as well as selecting the desired level of resistance to be provided by the indicator. As the safety indicator remains in place in the trigger guard it begins to conform no The trigger guard's shape, becoming more or less elongated as necessary.

The material of which the safety indicator is made is a flexible, resilient plastic or polymer such as polypropylene or polyurethane. The material should be durable and capable of repeated or continuous deformation without cracking or otherwise breaking down. Other flexible materials may be used, including rubber or rubber-like materials.

The color of the safety indicator is a matter of choice, but in the preferred embodiment, it is blue, which is the universally recognized color for "cold". In this case, "cold" means that the weapon is unloaded, or "safe" In addition to the use of blue as an indicator of safety, optional warning messages may be imprinted on the sidewalls or diaphragm, cautioning the user not to attempt to use the indicator in a loaded gun, and to make sure that the gun is unloaded prior to inserting the indicator.

The safety indicator of the present invention is not limited to use in handguns—it may be used in any weapon or tool that has a trigger guard, including rifles, machine guns and assault weapons, spear guns, crossbows, and nail guns. The safety indicator can provide greater peace of mind for individuals who keep weapons in their homes, and can instill greater awareness in gun users by providing a device which requires them to purposefully unload the gun, decreasing the risk of inadvertently storing an unlocked loaded weapon.

It will be evident that there are additional embodiments which are not illustrated above but which are clearly within the scope and spirit of the present invention. The above description and drawings are therefore intended to be exemplary only and the scope of the invention is to be limited solely by the appended claims.

I claim:

1. A universal loading indicator for an unloaded gun having a trigger guard opening with an inner circumference between a depressed trigger and a trigger guard, said loading indicator comprising:

a cap formed from a flexible, resilient material, said cap comprising:

a closed end wall having a generally oval shape with a first circumference in a relaxed state of at least as large as said inner circumference of said trigger guard opening and having a first degree of flexibility to permit deformation of said closed end wall when pressure is applied generally at its center so that an effective circumference of said closed end wall is decreased to allow it to pass through said trigger guard opening and to allow said closed end wall to resile when said pressure is removed;

a sidewall adjoining and perpendicular to said closed end wall having a second degree of flexibility greater than said first degree of flexibility to permit said sidewall to be compressed and conform to said inner circumference; and a flange on an end of said sidewall opposite said closed end wall, said flange having a second circumference greater than said inner circumference;

wherein said cap is inserted by applying said pressure to said closed end wall pushing through said trigger guard opening until forward progress of said cap is halted by said flange contacting said trigger guard so that said cap is locked within said trigger guard opening by said flange and said closed end wall which resiles to said first circumference after passing through said trigger guard opening, and said cap is removed by applying said pressure to said closed end wall to reduce said effective circumference, pushing said closed end wall back through said trigger guard opening.

2. A universal loading indicator as in claim 1 wherein said cap further comprises a groove on an inside of said cap at an intersection of said closed end well and said sidewall to provide greater compressibility.

3. A universal loading indicator as in claim 1 wherein said flexible, resilient material is polypropylene.

4. A universal loading indicator as in claim 1 wherein said flexible, resilient material is polyurethane.

5. A universal loading indicator as in claim 1 wherein said first circumference is large relative to said inner circumference to provide an increased degree of resistance in removing said cap from said trigger guard opening.

* * * * *

UNITED STATES PATENT AND TRADEMARK OFFICE

CERTIFICATE OF CORRECTION

PATENT NO. : 5,371,965

DATED : DECEMBER 13, 1994

INVENTOR(S) : STEPHEN G. NELSON

It is certified that error appears in the above-indentified patent and that said Letters Patent is hereby corrected as shown below:

- COLUMN 6, CLAIM 2, LINE 5, REPLACE "WELL" WITH --WALL--.

Signed and Sealed this

Twenty-fifth Day of April, 1995

*Attest:*

Bruce Lehman

BRUCE LEHMAN

*Attesting Officer*

*Commissioner of Patents and Trademarks*